United States Patent [19]

Sharples

[11] Patent Number: 4,728,946

[45] Date of Patent: Mar. 1, 1988

[54] AC COUPLED LCD ANNUNCIATOR CONTROL SYSTEM

[76] Inventor: Kenneth R. Sharples, 102 Herbert Rd., Braintree, Mass. 02185

[21] Appl. No.: 792,451

[22] Filed: Oct. 29, 1985

[51] Int. Cl.[4] ..... G09G 3/18

[52] U.S. Cl. ..... 340/765; 340/784; 340/811; 350/332

[58] Field of Search ..... 340/765, 784, 811; 350/332

[56] References Cited

U.S. PATENT DOCUMENTS 3,947,721 3/1976 Suenami et al. ..... 340/765

4,429,304 1/1984 Fujita ..... 340/765

*Primary Examiner*—Gerald L. Brigance

*Assistant Examiner*—Jeffery A. Brier

*Attorney, Agent, or Firm*—Joseph S. Iandiorio; Douglas E. Denninger

[57] ABSTRACT

An AC coupled LCD annunciator control system including a primary backplane electrode associated with the primary character segments, an annunciator backplane electrode associated with the annunciator segments, a backplane drive for providing a drive signal for the primary backplane electrode, and a capacitor for coupling the drive signal to the annunciator backplane electrode; a plurality of annunciator segments; a resistor interconnected between each annunciator segment and the annunciator backplane electrode; and means for selectively switching the impedance level of each said annunciator segment from a level which is above that of the resistor to a level which is below that of the resistor to provide at the lower impedance condition an AC signal between the selected annunciator segment and the annunciator backplane electrode to actuate that selected annunciator segment.

6 Claims, 7 Drawing Figures

AC COUPLED LCD ANNUNCIATOR CONTROL SYSTEM

FIELD OF INVENTION

Figure 1:
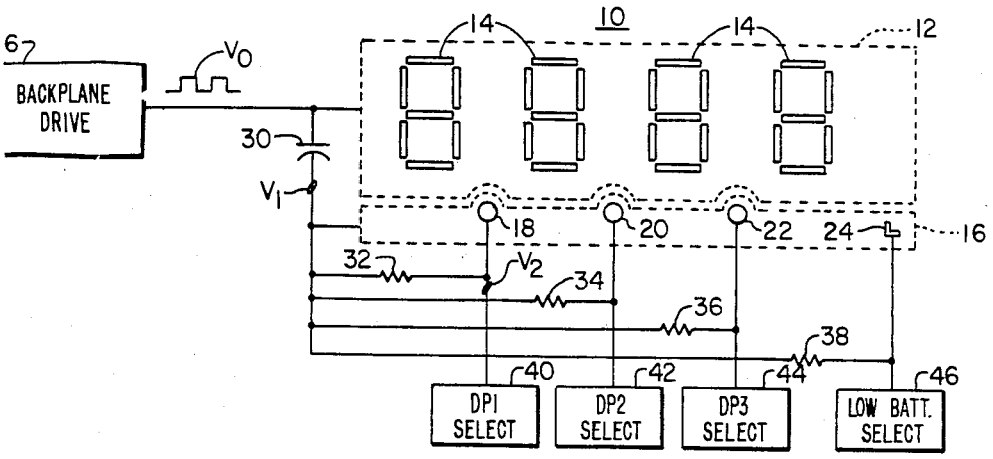

This invention relates to a control system for LCD display annunciators, and more particularly to such a system which utilizes multiple backplanes to reduce circuit complexity.

BACKGROUND OF INVENTION

A liquid crystal is an ordered fluid of a class called nematic. Nematic fluids used for liquid crystal displays are made up of cigar-shaped organic molecules which are aligned in the same direction.

The display is constructed from two pieces of glass coated on the inner surfaces with transparent indium oxide conductors. On the first glass inner surface the conductive coating is shaped to the individual segments of the display (each segment being terminated to an individual contact pad). The second glass inner surface is a single conductive coating shaped to be common to all segments. This common conductor is called the backplane. The inner glass surfaces are also specially treated to align the molecules of the nematic fluid in a direction parallel to the plane of the glass. The first and second glass surfaces are further treated so that the molecules on the first glass inner surface are aligned 90° from the molecules on the second glass inner surface. This alignment causes a twist in the molecular layers from one surface to the other. Displays constructed this way are called twisted Nematic Liquid Crystal Displays and are the most common.

The plane of polarization of polarized light will follow this twist and will exit the cell rotated 90°. If the cell is put between crossed polarizers the cell appears clear. By applying an electrical field across the cell the twist is eliminated, since the molecules align themselves parallel to the electric field, and the cell appears dark. If the cell were put between parallel polarizers the cell would appear dark with no electrical field applied and light with a field applied. It is important that only an AC field be applied since a DC field causes electrolysis and deterioration of the electrodes.

Presently, each display segment is driven by a circuit including an exclusive OR gate connected to the segment electrode. A square wave is provided to the backplane and to one input of the exclusive OR gate; the other input of the gate is controlled by segment decoders. A logic "0" input produces a square wave output in phase with the input producing zero volts across the cell while a logic "1" inverts the square wave (180° inversion) producing an RMS voltage equal to ½ the peak-to-peak voltages. Commercially available integrated circuit chips, e.g., the ICL 7136 available from Intersil, include circuits for driving numeral display segments but lack annunciator drive circuits. For most applications, annunciators such as decimal points, low battery indication, or identifiers such as volt or ohm indicators for meters must be controlled by additional external logic including the exclusive OR gate arrangement discussed above. One such logic chip is the CD 4076, a standard CMOS integrated circuit, available from many sources.

SUMMARY OF INVENTION

It is therefore an object of this invention to provide an improved, simplified LCD control system that controls the potential across annunciator segment electrodes.

It is a further object of this invention to provide such an LCD control system which greatly reduces circuit complexity over conventional annunciator drive systems.

It is a further object of this invention to provide such an LCD control system which is smaller than conventional annunciator drive systems.

It is a further object of this invention to provide such a control system which is less costly.

This invention results from the realization that a truly effective LCD annunciator control system may be achieved by using a backplane signal capacitively coupled to an annunciator backplane to drive annunciator segments by selectively switching the impedance of a selected annunciator segment from a high impedance to a low impedance to provide an AC potential between the annunciator segment and the annunciator backplane.

The invention features an AC coupled annunciator control system including a primary backplane electrode associated with the primary character segments and an annunciator backplane electrode associated with the annunciator segments. There is a backplane drive for providing a drive signal for the primary backplane electrode. A capacitor couples the drive signal to the annunciator backplane electrode. There are a plurality of annunciator segments and a resistor interconnected between each annunciator segment and the annunciator backplane electrode. There are means for selectively switching the impedance level of each annunciator segment from a level which is above that of the resistor to a level which is below that of the resistor to provide at the lower impedance condition an AC signal between the selected annunciator segment and the annunciator backplane electrode to actuate that annunciator segment.

In preferred embodiments the impedance level moves from a level at least an order of magnitude higher than that of the resistor to a level at least an order of magnitude lower than that of the resistor. The resistor may have a resistance in the range of 200 Kohms to 2 Mohms. The capacitor may have a capacitance of approximately 0.1 μf. The capacitor may be in a range from 0.05 to 1.5 μf. The capacitor and resistor may provide a time constant which is greater than that of the backplane signal. The capacitor and resistor time constant may be an order of magnitude or more greater than that of the backplane signal.

DISCLOSURE OF PREFERRED EMBODIMENT

Other objects, features and advantages will occur from the following description of a preferred embodiment and the accompanying drawings, in which:

FIG. 1 is a schematic diagram of an AC coupled LCD annunciator control system according to this invention; and FIGS. 2A–2C and 3A–3C show the voltage levels across the annunciator segments and annunciator backplane with the selector circuits opened and closed, respectively.

The invention may be accomplished with an AC coupled LCD annunciator control system which includes a primary backplane electrode associated with the primary character segments and an annunciator backplane electrode associated with the annunciator segments. The backplane drive provides a conventional square wave drive signal for the primary backplane electrode. A capacitor couples that drive signal to the annunciator backplane electrode as well. There are a plurality of annunciator segments associated with the annunciator backplane electrode, and there is a resistor interconnected between each of the annunciator segments and the annunciator backplane electrode. Each of the annunciator segments has associated with it means for selectively switching the segment between a very high impedance level, typically an order of magnitude or more above the value of the resistor, to a low impedance level, typically an order of magnitude or more below the resistor level.

When the switch is opened, that is, the impedance level is relatively high with respect to the resistor, the drive plane signal coupled through the capacitor to the annunciator backplane electrode appears at both ends of the resistor, that is, across the annunciator segment and the annunciator backplane electrode, so that there is effectively no RMS voltage across the segment and its associated backplane electrode. However, when the switch is closed, that is, when a relatively low impedance is applied to that segment, the voltage level of that segment is brought to ground. Then the voltage across the resistor and across the segment and the annunciator backplane electrode is effectively the drive signal itself so that an RMS signal is provided between the segment and its backplane, and the segment is actuated.

There is shown in FIG. 1 an AC coupled LCD annunciator control system 10 according to this invention, including a primary backplane electrode 12 associated with a number of independently driven character segments 14 and an annunciator backplane electrode 16 associated with a plurality of annunciator segments such as decimal point segments 18, 20, 22, and low-battery annunciator segment 24. Primary backplane electrode 12 is driven by a conventional backplane drive 26, which provides a square wave output $V_0$ oscillating between approximately 0–5 volts at a frequency of 30–100 Hz, with a period of 33 to 10 milliseconds. Backplane drive 26 may be provided as one of the conventional components in an ICL 7136, 7106, 7116, 7126, or 7126A, all available from Intersil.

In accordance with this invention, annunciator backplane electrode 16 is coupled to primary backplane electrode 12 by means of capacitor 30. Each segment 18, 20, 22 and 24 is also individually coupled to the associated backplane 16 by means of a resistor 32, 34, 36 and 38, respectively. These resistors may be between 200 Kohms and 2 Mohms, typically 500 Kohms, when capacitor 30 is between 1.5 and 0.05 $\mu$f and the backplane drive signal has a period of 33 to 10 msec. Each segment 18, 20, 22 and 24 has associated with it a selector circuit 40, 42, 44, and 46, respectively. When the particular select circuit is open, the impedance of the associated segment is relatively high with respect to the associated resistor. For example, for a resistor of 0.5 Mohms the impedance would be 5 Mohms or more. In that condition the voltage on the annunciator segment tracks that of the annunciator backplane electrode and there is no voltage across the LCD. However, when the particular select circuit is closed the impedance is dropped to a low impedance; for example, when the resistor is approximately 0.5 Mohms the resistance would drop below 50,000 ohms. In this condition the annunciator segment moves toward ground when the select circuit is closed and an AC signal is provided across the crystal between the annunciator segment and the associated annunciator backplane.

Figure 2A:
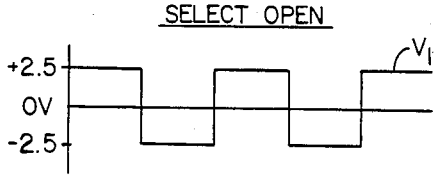
Figure 2B:
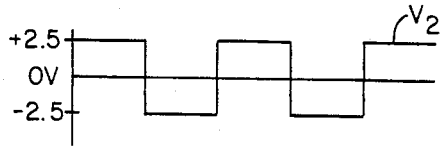
Figure 3B:
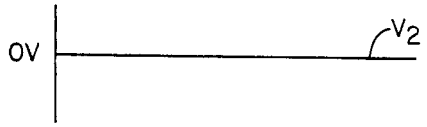
Figure 2C:
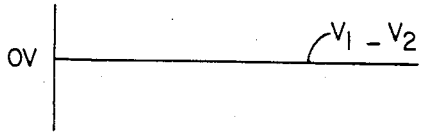
Figure 3C:
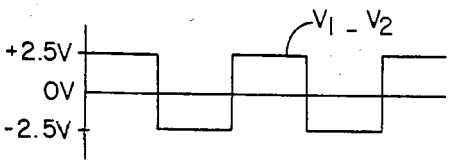

This can be seen more clearly with respect to FIGS. 2 and 3, comparing the voltages $V_1$ and $V_2$, FIG. 1, across resistor 32 in parallel with annunciator segment 18 and the annunciator backplane electrode 16. The drive plane signal $V_0$, FIG. 1, appears as $V_1$, FIG. 2A, an AC signal varying between +2.5 and −2.5 volts. With select circuit 40 in the open condition the voltage $V_2$, FIG. 2B, on the other side of resistor 32 and segment 18 is identical with that of $V_1$, FIG. 2A. Thus the potential difference across the crystal between segment 18 and electrode 16, that is, the difference between $V_1$ and $V_2$, is zero, as shown in FIG. 2C.

Figure 3A:
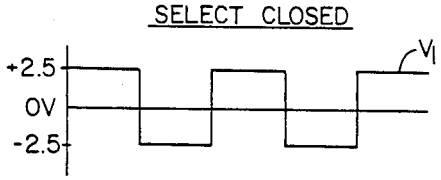

In contrast, when the select circuit 40 is closed, voltage $V_1$, FIG. 3A, remains as voltage $V_1$ in FIG. 2A. However, voltage $V_2$, FIG. 3B, at segment 18 is held at zero volts. Thus the difference between $V_1$ and $V_2$, or the potential across segment 18 and electrode 16, appears as $V_1$ minus $V_2$ in FIG. 3C, i.e., an RMS voltage varying between +2.5 and −2.5 volts. Thus there is a sufficient potential between segment 18 and electrode 16 to actuate segment 18.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. An AC coupled LCD annunciator control system comprising:

a primary backplane electrode associated with primary character segments;

a plurality of annunciator segments;

an annunciator backplane electrode associated with said annunciator segments;

a backplane drive for providing a drive signal for said primary backplane electrode;

a capacitor for coupling said drive signal to said annunciator backplane electrode;

a resistor interconnected between each said annunciator segment and said annunciator backplane electrode, and means for selectively switching the impedance level of each said annunciator segment from a level which is above that of said resistor to a level which is below that of said resistor to provide an AC signal between the selected annunciator segment and the annunciator backplane electrode to actuate that annunciator segment.

2. The LCD annunciator control system of claim 1 in which said means for selectively switching switches the impedance level between a level at least an order of magnitude higher than said resistor and a level which is at least an order of magnitude lower than said resistor.

3. The LCD annunciator control system of claim 1 in which each said resistor has a resistance of 200 Kohms to 2 Mohms.

4. The LCD annunciator control system of claim 1 in which said capacitor has a capacitance of 0.05 to 1.5 $\mu$f.

5. The LCD annunciator control system of claim 1 in which said capacitor and said resistor provide a time constant greater than that of said drive signal.

6. The LCD annunciator control system of claim 5 in which said time constant is at least an order of magnitude greater than that of said drive signal.

* * * * *